US006340312B1

(12) United States Patent
Ko

(10) Patent No.: US 6,340,312 B1
(45) Date of Patent: Jan. 22, 2002

(54) CABLE END CONNECTOR HAVING A COMPLETE EMI SHIELDING

(75) Inventor: David Tso-Chin Ko, Thousand Oaks, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/797,139

(22) Filed: Feb. 28, 2001

(51) Int. Cl.[7] ..... H01R 17/18
(52) U.S. Cl. ..... 439/582; 439/585
(58) Field of Search ..... 439/578–585, 439/854, 855, 856, 63

(56) References Cited

U.S. PATENT DOCUMENTS 4,799,900 A * 1/1989 Capp et al. ..... 439/585
5,879,190 A * 3/1999 Maruyama et al. ..... 439/582
6,099,350 A * 8/2000 Wright ..... 439/582

* cited by examiner

*Primary Examiner*—Hien Vu
(74) *Attorney, Agent, or Firm*—Wei Te Chung

(57) ABSTRACT

A cable end connector includes a dielectric housing (10), a terminal (30) received in the housing, a shell (50) shielding the housing, and a retainer (60) attached to the shell for holding a coaxial cable (70) therein. The shell has a pair of arms (513) for accommodating a tail portion (31) of the terminal therebetween. A sealing tab (5133) extends from an end of each arm and encloses an end of the coaxial cable, and cooperates with the retainer to provide a complete Electro Magnetic Interference (EMI).

3 Claims, 7 Drawing Sheets

CABLE END CONNECTOR HAVING A COMPLETE EMI SHIELDING

FIELD OF THE INVENTION

The present invention relates to a connector, and more particular to a cable end connector having a complete Electro Magnetic Interference (EMI) shielding.

BACKGROUND OF THE INVENTION

A cable end connector is often used for connecting a cable with an electronic device for transmitting Radio-frequency (RF) signal. A conventional cable end connector is, for example, disclosed in U.S. Pat. No. 5,263,877. The cable end connector includes a dielectric member holding a central terminal within an outer conductive shell. The central terminal has a U-shaped connection portion for connecting with a coaxial cable and a coupling portion for mating with a complementary plug. As disclosed in this patent, in assembly, an upper side wall of the dielectric member and a holder portion of the outer shell are bent substantially at a right-angle to hold the connection portion of the terminal and an inner conductor of the coaxial cable within the dielectric member and to crimp the coaxial cable braiding to the connector outer shell.

However, the holder portion has a pair of first wing portions bent around the dielectric member, and a pair of second wing portions bent around a braiding layer of the coaxial cable. A gap between the first and the second wing portions results in an incomplete shielding, whereby a failure in signal transmission would likely occur.

Hence, an improved connector for providing a complete Electro Magnetic Interference (EMI) shielding is required to overcome the disadvantage of the prior art.

The copending application Ser. No. 09/709,226 filed Nov. 8, 2000 with the same inventor and the same assignee, discloses an approach to replace the design of U.S. Pat. No. 5,263,877, and the instant application specifically focuses on the complete EMI shielding issue thereof.

BRIEF SUMMARY OF THE INVENTION

A main object of the present invention is to provide a cable end connector reliably shielding against Electro Magnetic Interference (EMI).

A cable end connector according to the present invention comprises a dielectric housing, a terminal received in the housing, a unitarily formed shell, and a retainer attached to the shell for holding a coaxial cable therein.

The housing includes a base portion and a tubular portion engaged with the base portion. The tubular portion axially defines a passageway therethrough. The terminal has a mating portion and a tail portion perpendicular to each other. The mating portion extends into the passageway for mating with a complementary connector. The tail portion is retained on the base portion for connecting with an inner conductor of the coaxial cable. The shell comprises a planar portion supporting the housing, and a trunk portion bendably connected to the planar portion and enclosing the tubular portion of the housing. A pair of arms rearwardly extend from the trunk portion. Each arm has a straight portion connecting with the tubular portion, a sealing tab and a bending portion protruding inwardly and connecting the straight portion with the sealing tab. The arms and a portion of the retainer define a space for accommodating the tail portion of the terminal. The retainer has a braiding crimp at an end thereof extending rearwardly beyond the arms of the trunk portion for grounding a braiding layer of the coaxial cable. Each sealing tab is located in the retainer, sealing a gap between a locking tab of the retainer and the braiding crimp. By this arrangement, the Electro Magnetic Interference (EMI) shielding is complete.

Other objects, advantages and novel features of the invention will become more apparent from the following detailed description when taken in conjunction with the accompanying drawings.

DETAILED DESCRIPTION OF THE INVENTION

Figure 1:
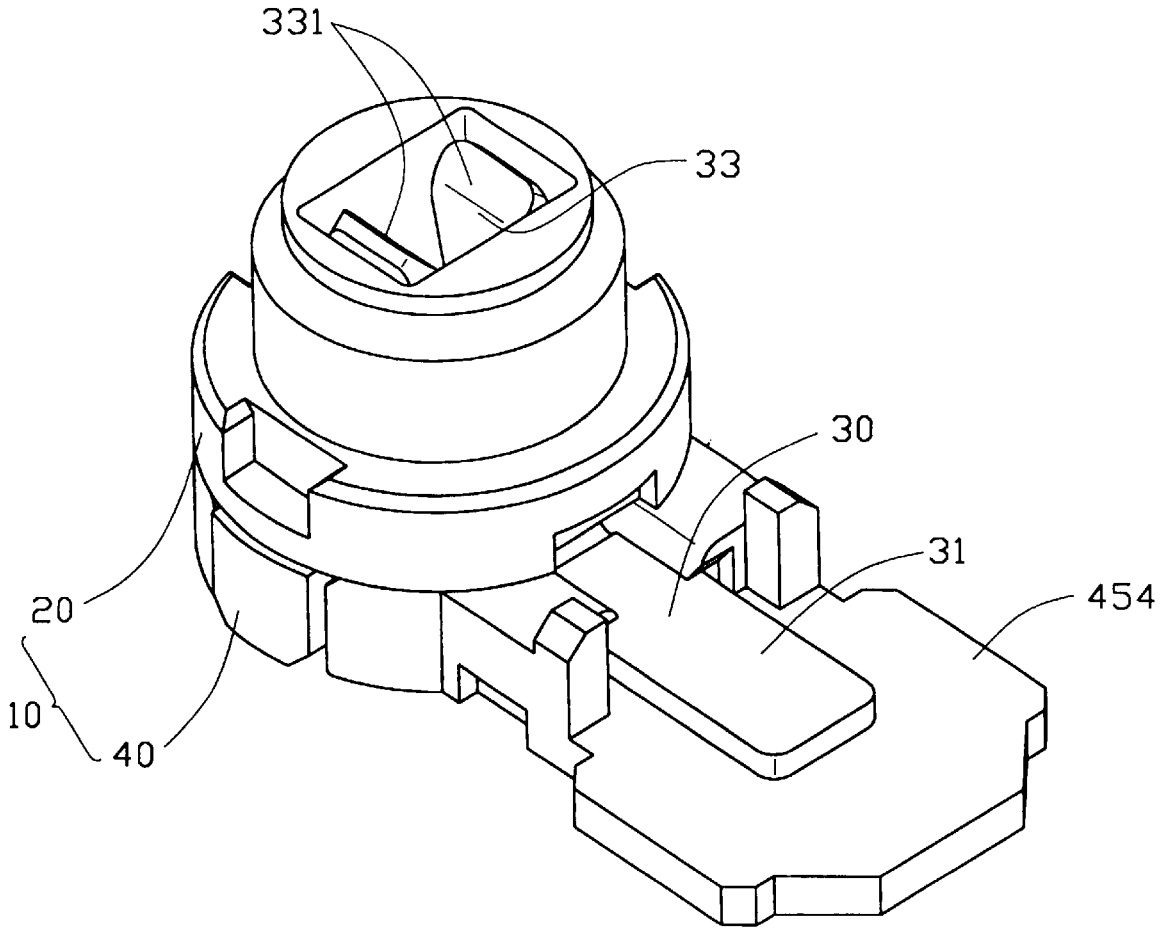
FIG. 1 is a perspective view of a terminal assembled within a housing of a cable end connector according to the present invention.
Figure 4:
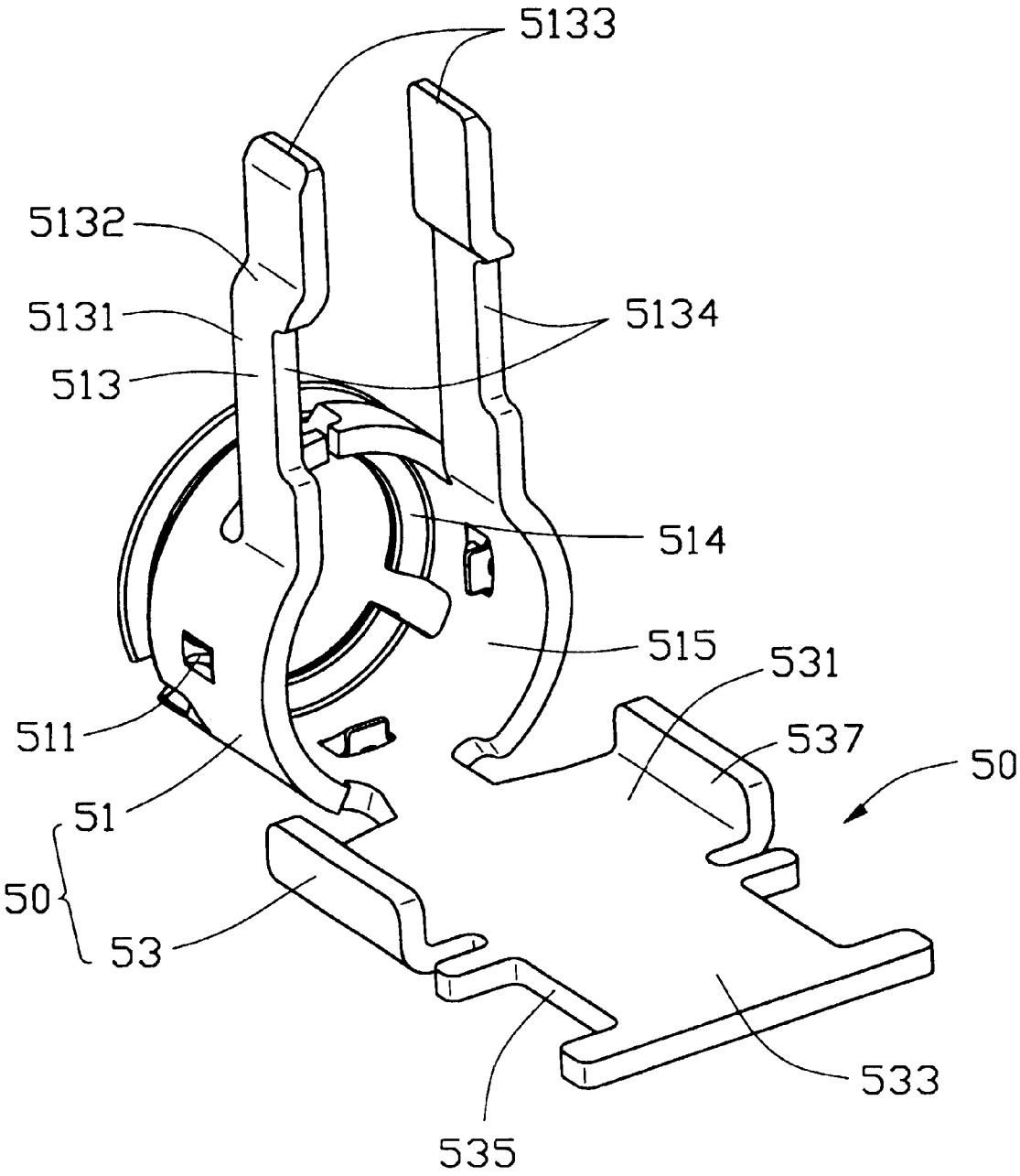
FIG. 4 is a perspective view of a shell of the cable end connector, showing a trunk portion in a state before it is bent toward a planar portion thereof.
Figure 5:
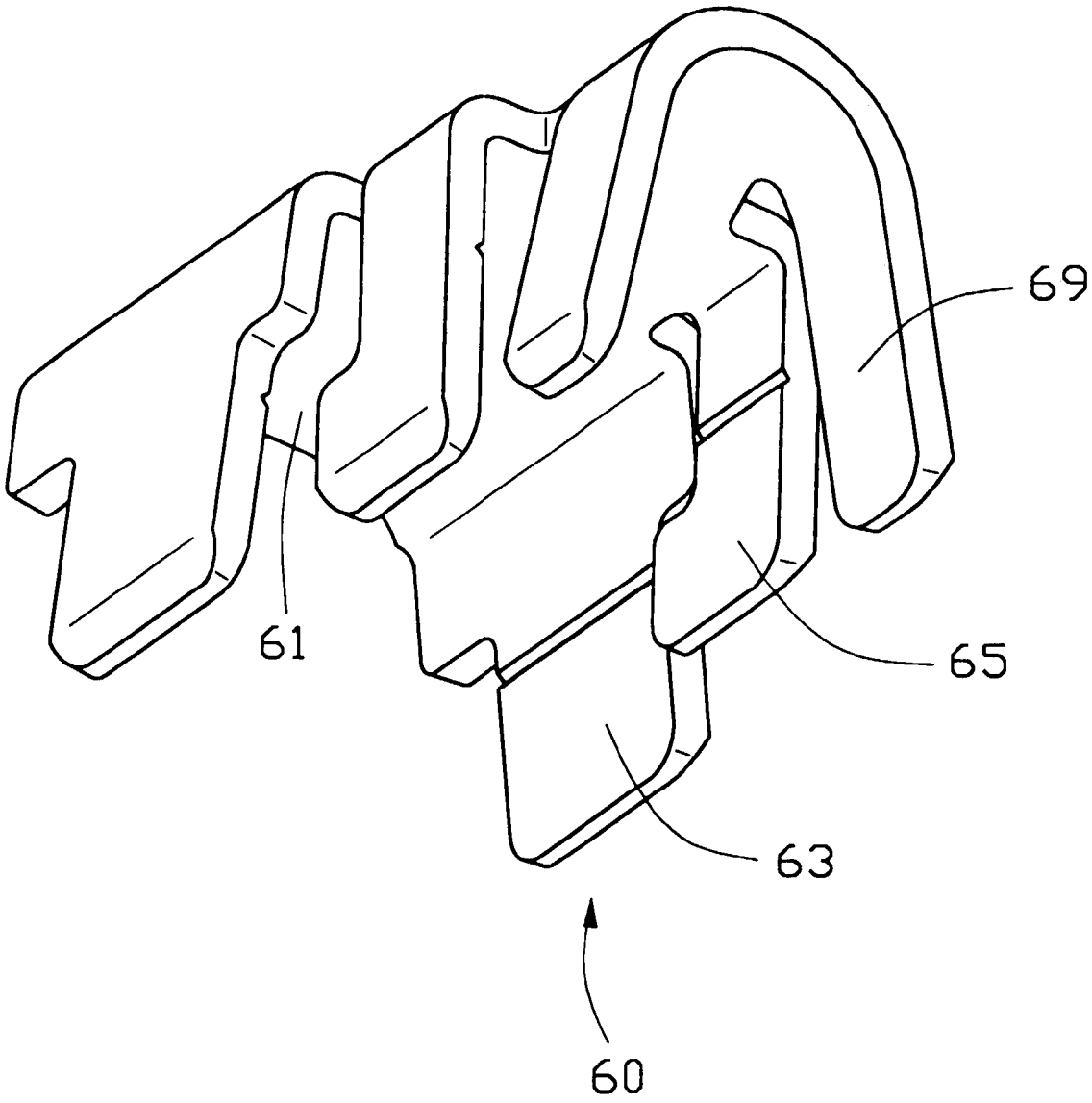
FIG. 5 is a perspective view of an unbentretainer of the cable end connector.

Referring to the drawings and particularly to FIGS. 1, 4 and 5, a cable end connector in accordance with the present invention comprises a dielectric housing 10, a terminal 30, a metallic shell 50 shielding the housing 10 and the terminal 30, and a retainer 60 for securing an end portion of a coaxial cable 70.

Figure 2:
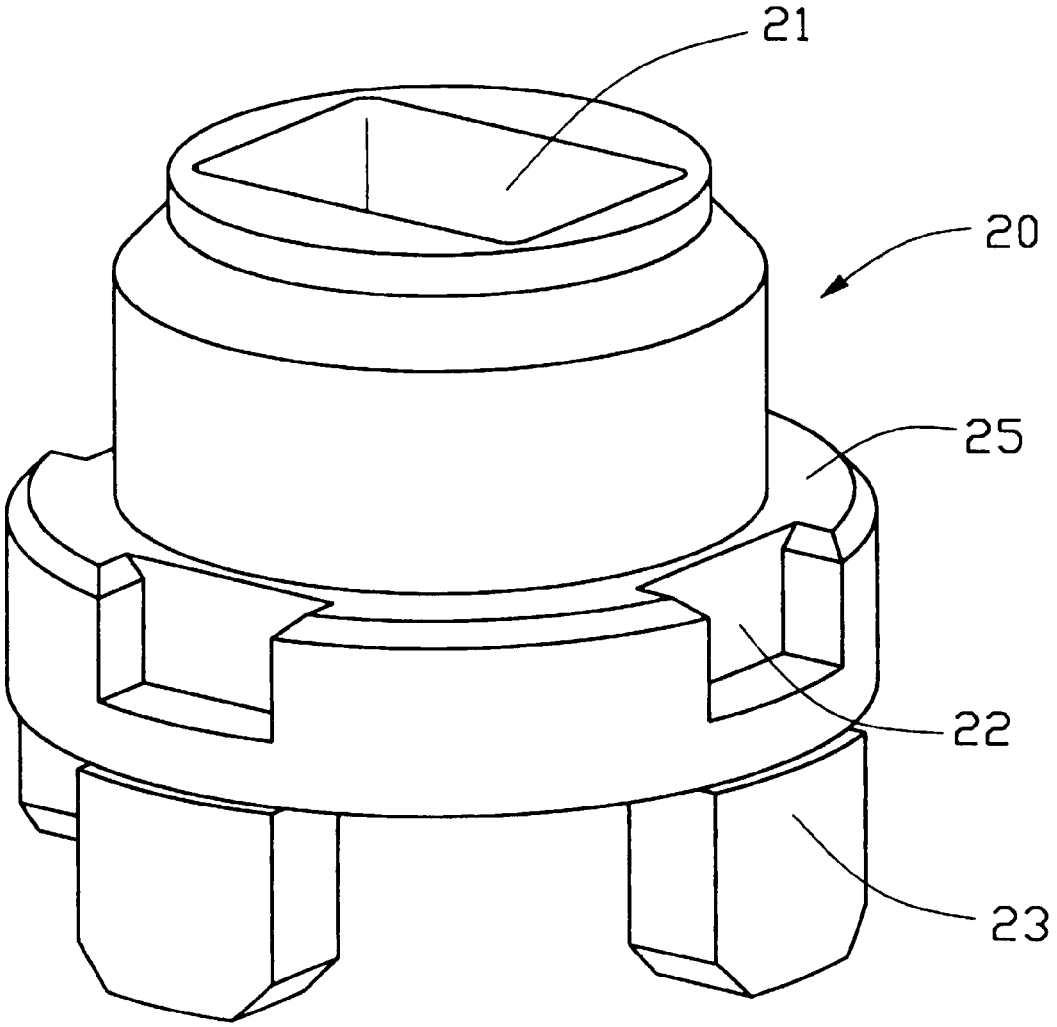
FIG. 2 is a perspective view of a tubular portion of a housing of the cable end connector.

Referring to FIG. 1, the dielectric housing 10 comprises a tubular portion 20 and a base portion 40 for engaging with the tubular portion 20. Particularly referring to FIG. 2, a substantially rectangular passageway 21 is axially defined through the tubular portion 20. Preferably, the tubular portion 20 forms a step 25 around an outer periphery thereof for supporting the shell 50. Three recesses 22 are angularly defined in the step 25. Three mounting legs 23 angularly depend from a bottom of the tubular portion 20 for locking with the base portion 40.

Figure 3:
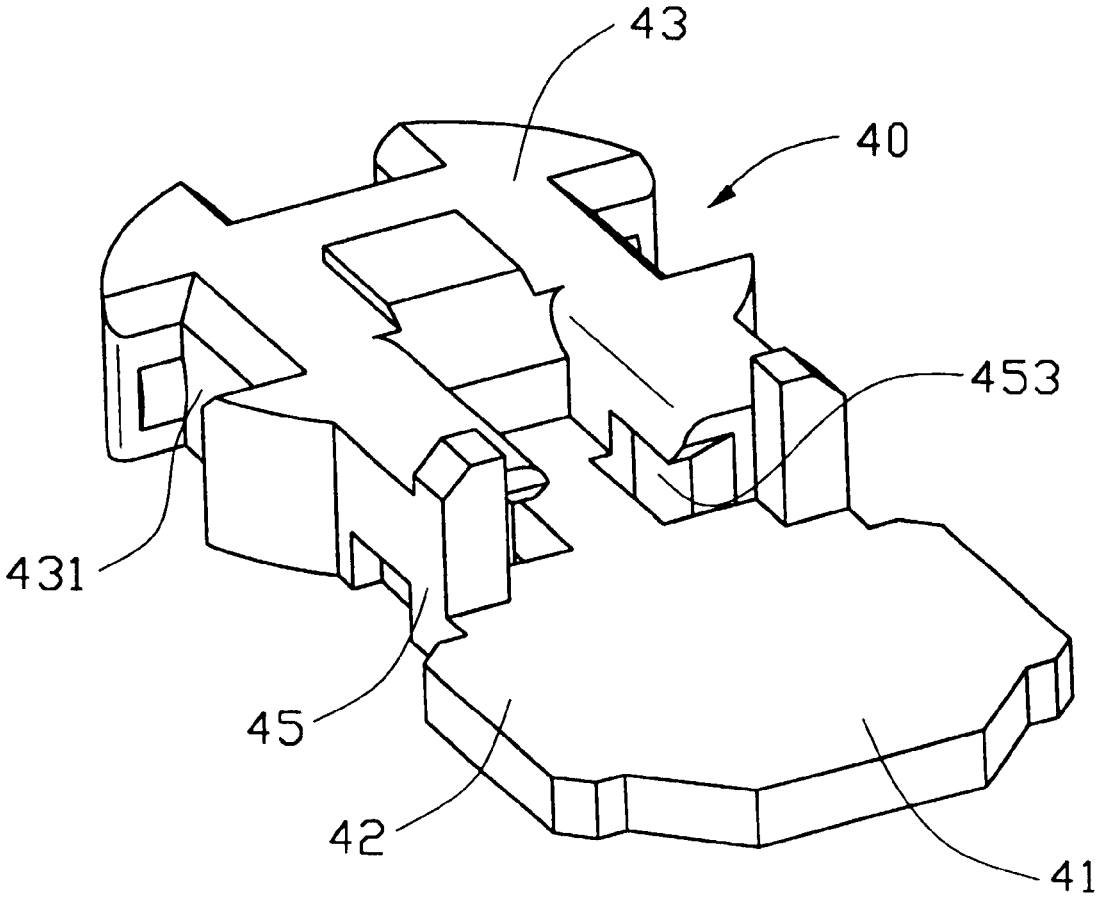
FIG. 3 is a perspective view of a base portion of the housing.

Particularly referring to FIG. 3, the base portion 40 comprises an engaging block 43 and a flat portion 41 extending rearwardly from the engaging block 43. A pair of retaining walls 45 project along the opposite sides of the flat portion 41 and a pair of projecting wings 42 adjacent the retaining walls 45 protrude respectively and horizontally from the opposite sides of the flat portion 41. A pair of grooves 453 are respectively defined in an inward lower corner of each retaining wall 45 opposing each other. Three recesses 431 are angularly distributed in an outer periphery of the engaging block 43 and dimensioned for retaining the mounting legs 23.

Referring to FIG. 1, the terminal 30 includes a mating portion 33 and a planar tail portion 31 substantially perpendicular to each other. The mating portion 33 is bifurcated and consists of a pair of beams 331 substantially projecting toward each other for mating with a complementary connector (not shown).

The shell 50 is unitarily formed and comprises a cylindrical trunk portion 51 and a planar portion 53 connected to the trunk portion 51. FIG. 4 shows the shell 50 when the trunk portion 51 is unbent and is approximately perpendicular to the planar portion 53.

The trunk portion 51 has a pair of arms 513 rearwardly extending from a lower portion thereof. Each arm 513 has a straight portion 5131, a transition portion 5132 inwardly and rearwardly extending from the straight portion 5131, and a sealing tab 5133 rearwardly extending from the transition portion 5132. A recess 5134 is downwardly defined in a lower portion of the straight portion 5131. The trunk portion 51 defines a hollow portion 515 therethrough for enclosing the tubular portion 20 of the housing 10. Preferably, a step 514 is formed on an inner periphery of the trunk portion 51 for cooperating with the step 25 of the housing 10. Three hooks 511 inwardly protrude on the hollow portion 515 for engaging with the three recesses 22 of the housing 10.

The planar portion 53 has a front portion 531 for supporting the trunk portion 51, and a rear portion 533 rearwardly extending from the front portion 531 for supporting the arms 513 and the housing 10. The front portion 531 forms a pair of side walls 537 on opposite sides thereof for interferentially fitting with the outer periphery of the trunk portion 51. A pair of recesses 535 are respectively defined in opposite sides of the rear portion 533.

Figure 6:
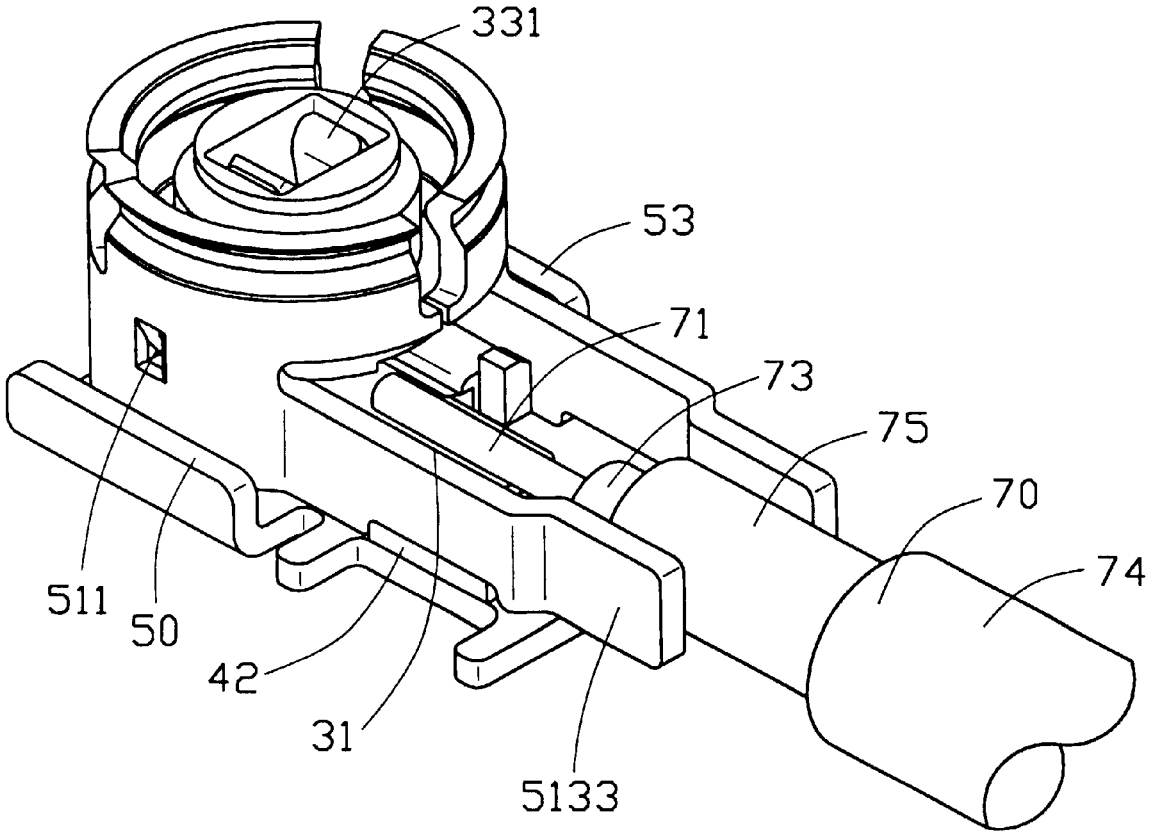
FIG. 6 is a perspective view of a cable end connector of the present invention assembled with an end portion of a cable without a retainer.
Figure 7:
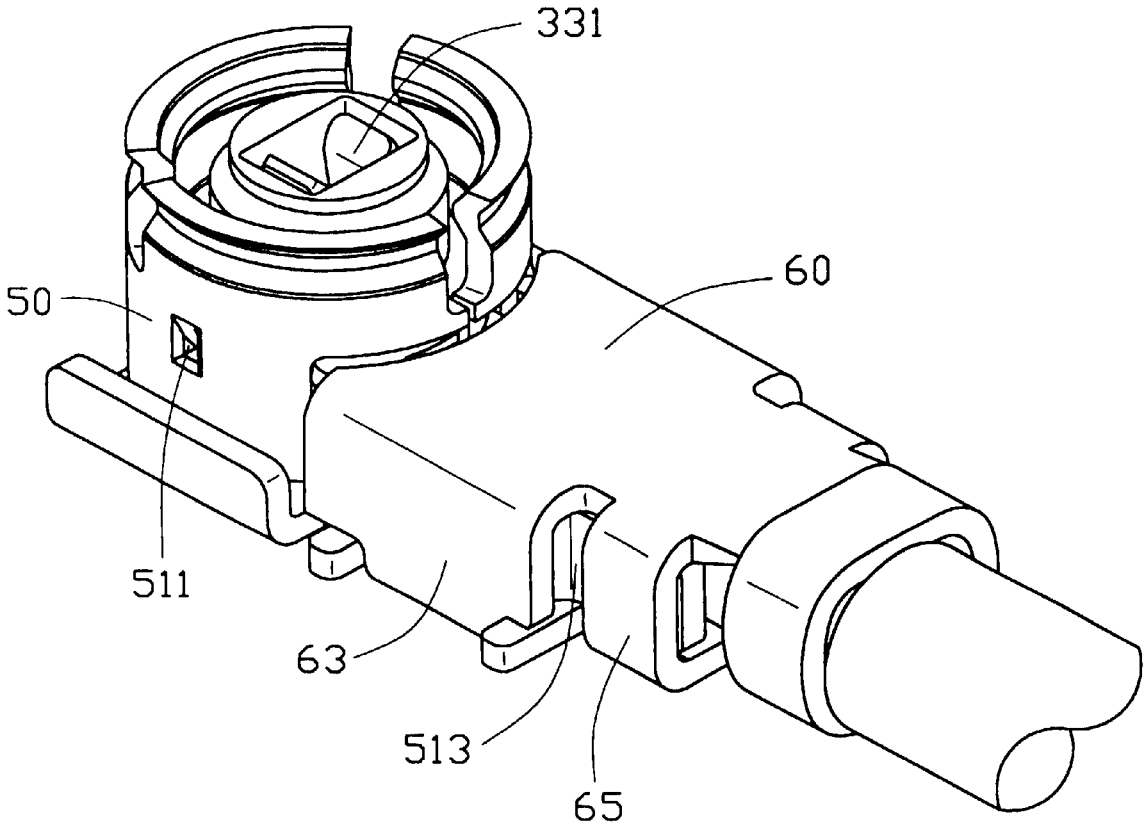
FIG. 7 is a view similar to FIG. 6 but with a retainer crimped around a part of the cable end connector.

With reference to FIGS. 5 and 7, the retainer 60 is conductive and comprises a planar top wall 61, a braiding crimp 65 rearwardly extending from an edge of the top wall 61 for grounding a braiding layer 73 of the coaxial cable 70 (see FIG. 6), and a strain relief 69 rearwardly extending from the braiding crimp 65 for securely clamping the coaxial cable 70. A pair of locking tabs 63 respectively depend downwardly from opposite sides of the top wall 61 for engaging with the recesses 535 of the planar portion 53.

Particularly referring to FIG. 6, the coaxial cable 70 includes an inner conductor 71, a braiding layer 73, an inner insulator 72 separating the inner conductor 71 and the braiding layer 73, and an outer insulator 74 surrounding the braiding layer 73.

Referring to FIGS. 6 and 7, a cable end connector assembly is assembled as follows.

(1) The tail portion 31 of the terminal 30 is inserted from the flat portion 41 of the base portion 40 of the housing 10, with both sides (not labeled) thereof retained in the grooves 453.

(2) The tubular portion 20 of the housing 10 is mounted onto the base portion 40. The mating portion 33 of the terminal 30 extends into the passageway 21 of the tubular portion 20, the beams 331 of the mating portion 33 abutting against corresponding inner walls (not labeled) of the passageway 21.

(3) An inner conductor 71 of the coaxial cable 70 is soldered onto the tail portion 31 of the terminal 30.

(4) The trunk portion 51 of the shell 50 is brought to encircle the tubular portion 20 of the housing 10. The arms 513 accommodate the flat portion 41 of the housing 10 therebetween.

(5) The planar portion 53 is bent toward the trunk portion 51 until the planar portion 53 completely abuts a bottom of the housing 10.

(6) The locking tabs 63 of the retainer 60 engage with the corresponding recesses 535 of the planar portion 53, thereby fixedly retaining the arms 513 to an upper face of the planar portion 53. The tail portion 31 of the terminal 30 is therefore surrounded by both the arms 513 and the top wall 61 of the retainer 60 but without contacting either. The braiding crimp 65 of the retainer extends beyond the straight portions 5131 of the arms 513 for securely clamping the braiding layer 3 of the coaxial cable 70 by clamping the sealing tabs 5133. The outer insulator 74 of the coaxial cable 70 is firmly retained in the strain relief 69 of the retainer 60.

Particularly referring to FIG. 7, the sealing tabs 5133 extending in the retainer 60 seal a gap defined between the braiding crimp 65 and the locking tabs 63 and connect the braiding layer 73 with the retainer 60. By this arrangement, a complete and reliable Electro Magnetic Interference (EMI) shielding is obtained in this design.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector comprising:

a housing including a base portion having a pair of wings on sides thereof and a tubular portion engaged with said base portion;

a terminal received in said housing, the terminal having a tail portion supported on said base portion;

a metal shell including a planar portion attached to a bottom face of said base portion, and a trunk portion connected to said planar portion and enclosing said tubular portion of said housing, said trunk portion including a pair of arms extending along said wings of said base portion said base portion of said housing, each arm having a sealing tab extending from an end thereof; and a retainer covering said planar portion and said arms for retaining said arms to said planar portion but not contacting said tail portion of said terminal, said sealing tabs being adapted for accommodating a braiding layer of the cable, said retainer enclosing said sealing tab therein; wherein the retainer includes a braiding crimp for grounding a braiding layer of a coaxial cable, and a pair of locking tabs respectively depends downwardly from opposite sides of the retainer for retaining the arms to the planar portion; wherein each of said arms defines a recess in an underside thereof to receive the corresponding wing so as to restrict movement of the arm relative to the base portion.

2. The cable end connector as claimed in claim 1, wherein the sealing tabs seal a gap defined between the braiding crimp and the locking tabs.

3. A cable end connector comprising:

a housing including a vertical tubular portion and a horizontal base portion, said base portion defining a pair of wings on two sides;

a terminal received in said housing, the terminal having a tail portion supported on said base portion;

a metal shell including a planar portion attached to a bottom face of said base portion, and a trunk portion connected to said planar portion and enclosing said tubular portion of said housing, said trunk portion including a pair of vertical arms extending horizontally away from said tubular portion and along said wings of said base portion of said housing; and a retainer covering said planar portion and said arms for retaining said arms to said planar portion; wherein each of said arms defines a recess in an underside thereof to receive the corresponding wing so as to restrict movement of the arm relative to the base portion; wherein said planar portion defines a pair of elongated notches on two sides thereof, and said retainer defines a pair of locking tabs on two sides thereof to respectively extend through the corresponding pair of notches and be bent against an underside of said planar portion.

* * * * *